US007934818B2

(12) United States Patent
Kanbe

(10) Patent No.: US 7,934,818 B2
(45) Date of Patent: May 3, 2011

(54) INK CARTRIDGES HAVING AN AIR INTAKE VALVE WHICH IS OPENED IN RESPONSE TO THE REMOVAL OF A PROTECTION MEMBER FROM A CASE OF THE INK CARTRIDGE

(75) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 503 days.

(21) Appl. No.: 11/372,379

(22) Filed: Mar. 10, 2006

(65) Prior Publication Data

US 2006/0203051 A1 Sep. 14, 2006

(30) Foreign Application Priority Data

Mar. 10, 2005 (JP) ..... 2005-068144

(51) Int. Cl.
*B41J 2/175* (2006.01)

(52) U.S. Cl. ..... 347/86; 347/85

(58) Field of Classification Search ..... 347/86, 347/87, 49, 85
See application file for complete search history.

(56) References Cited

U.S. PATENT DOCUMENTS 5,940,104 A * 8/1999 Karita et al. ..... 347/87
6,010,213 A 1/2000 Kanaya et al.
6,283,587 B1 * 9/2001 Umemura ..... 347/86
6,286,946 B1 9/2001 Umemura et al.
6,336,719 B1 * 1/2002 Ishinaga et al. ..... 347/86
6,450,630 B2 9/2002 Kanaya et al.
6,474,802 B1 * 11/2002 Lui ..... 347/86
6,676,251 B1 * 1/2004 Kamp ..... 347/86
6,786,583 B2 9/2004 Ota et al.
6,863,388 B2 * 3/2005 Seino et al. ..... 347/86
6,916,085 B2 * 7/2005 Kotaki et al. ..... 347/49
2001/0038407 A1 11/2001 Umemura et al.
2002/0071014 A1 * 6/2002 Matsumoto et al. ..... 347/87
2003/0085967 A1 5/2003 Ota et al.
2004/0165042 A1 8/2004 Ichihashi et al.
2004/0165043 A1 8/2004 Sakai et al.
2004/0165045 A1 8/2004 Sakai et al.
2004/0174418 A1 9/2004 Toba et al.
2006/0103702 A1 * 5/2006 Takagi ..... 347/86

FOREIGN PATENT DOCUMENTS

JP 9 85963 3/1997

(Continued)

OTHER PUBLICATIONS

Japan Patent Office; Office Action in Japanese Patent Application No. 2005-068144 (counter part to the above-captioned US Patent Application) mailed on Jul. 27, 2010.

(Continued)

*Primary Examiner* — Stephen D Meier
*Assistant Examiner* — Carlos A Martinez, Jr.
(74) *Attorney, Agent, or Firm* — Baker Botts L.L.P.

(57) ABSTRACT

A manipulating rod is provided on an air intake valve so as to project through an air intake port. A protective member is provided with a projection, which causes the manipulating rod to move so as to open the air intake valve, in response to a motion for detaching the protective member from an ink cartridge.

15 Claims, 15 Drawing Sheets

FOREIGN PATENT DOCUMENTS

| | | | |
|---|---|---|---|
| JP | 2000-117997 | A | 4/2000 |
| JP | 2002-337353 | A | 11/2002 |
| JP | 2003-145800 | A | 5/2003 |
| JP | 3430912 | | 5/2003 |
| JP | 2004-243759 | A | 9/2004 |

OTHER PUBLICATIONS

Japan Patent Office; Office Action in Japanese Patent Application No. 2005-068144 (counterpart to the above-captioned US Patent Application) mailed on Nov. 9, 2010.

* cited by examiner

INK CARTRIDGES HAVING AN AIR INTAKE VALVE WHICH IS OPENED IN RESPONSE TO THE REMOVAL OF A PROTECTION MEMBER FROM A CASE OF THE INK CARTRIDGE

CROSS-REFERENCE TO RELATED APPLICATIONS

This Nonprovisional application claims priority under 35 U.S.C. §119(a) on Patent Application No. 2005-068144 filed in Japan on Mar. 10, 2005, the entire contents of which are hereby incorporated by reference.

BACKGROUND

The present invention relates to an ink cartridge for storing therein ink to be supplied to a recording apparatus that prints letters, images or the like.

An inkjet printer that prints letters, images or the like is designed to form an image with minute droplets of ink. An ink cartridge storing the ink to be supplied to the inkjet printer is detachably mounted on a main body of the printer, so that the ink cartridge can be removed from the main body for replacement, when the stored ink has been consumed.

The ink cartridge includes an ink chamber for storing the ink therein, an ink supply port for supplying the ink to the printer and an air intake port for introducing air to the ink chamber or the like. At the point of sale in general, the entirety of the ink cartridge is vacuum-packed, and the ink chamber is depressurized.

Conventional ink cartridges, for example one disclosed in Japanese Patent Application Laid-Open No. 9-85963 (1997), include valves at the ink supply port and the air intake port respectively, to prevent leakage of the ink out of the ink chamber, such that once the ink cartridge is mounted on the printer two projecting portions provided in the printer press the respective valves upward, thus to open the valves. Air is introduced into the ink chamber once the projecting portion of the printer opens the valve that has kept the air intake port closed, upon mounting the ink cartridge on the printer.

The ink supplied to the printer through the ink supply port is ejected on a printing paper from a plurality of ejection nozzles incorporated in a printer head through an ink path of the printer, to thereby form a letter, an image or the like. When ejecting the ink through the ejection nozzles, the ejection status of the ink through the ejection nozzles has to be maintained in a constant level for securing a desired printing quality. For such purpose, the droplet of the ink formed at the ejection nozzles is led to have a concave curved portion, called a meniscus, on its liquid surface.

SUMMARY

The ink cartridge disclosed in Japanese Patent Application Laid-Open No. 9-85963 (1997), however, is designed such that both valves of the ink supply port and the air intake port are opened upon mounting the ink cartridge on the printer. Therefore, when the valve of the ink supply port is opened before the valve of the air intake port is opened, the ink in the ink path of the printer flows backward, since the ink chamber is depressurized. Besides, when the valve of the air intake port and the valve of the ink supply port are simultaneously opened, or even when the valve of the air intake port is opened earlier than the valve of the ink supply port, the ink in the ink path of the printer may still flow backward if the valve of the ink supply port is opened before sufficient air is introduced into the ink chamber. Such backflow of the ink that takes place upon replacing the ink cartridge destroys the meniscus formed so far at the ejection nozzles of the printer head by the ink loaded in the ink path, thereby impeding proper ejection of the ink.

In view of such situation, it is an object to provide an ink cartridge configured such that an air intake valve, which opens and closes the air intake port for introducing air into an ink chamber, is opened when detaching a protective member that protects the air intake port, so as to introduce sufficient air into the ink chamber before mounting the ink cartridge on a printer.

An ink cartridge according to a first aspect is an ink cartridge, comprising: a casing accommodating therein an ink chamber; an air intake port formed on the casing for introducing air into the ink chamber; an air intake valve that opens and closes the air intake port; a protective member removably attached to the casing so as to cover the air intake port; and a valve opening unit that opens the air intake valve in response to detachment of the protective member from the casing.

The ink cartridge according to the first aspect includes the valve opening unit that opens the air intake valve upon detachment of the protective member that protects the air intake port. Accordingly, when the protective member is detached from the ink cartridge for replacement thereof, the valve opening unit opens the air intake port once the protective member is detached, so as to introduce air into the ink chamber through the air intake port. Since the protective member of the ink cartridge is necessarily detached before use, an atmospheric pressure can be secured in the ink chamber by the time that the ink cartridge is mounted on the printer. This inhibits the ink in the ink path of the printer from flowing backward to thereby prevent the meniscus formed at the ejection nozzles of the printer head from being destroyed, which leads to smooth supply of the ink, thus maintaining high printing quality.

The above and further objects and features will more fully be apparent from the following detailed description with accompanying drawings.

DETAILED DESCRIPTION OF THE EXEMPLARY EMBODIMENTS

Figure 1:
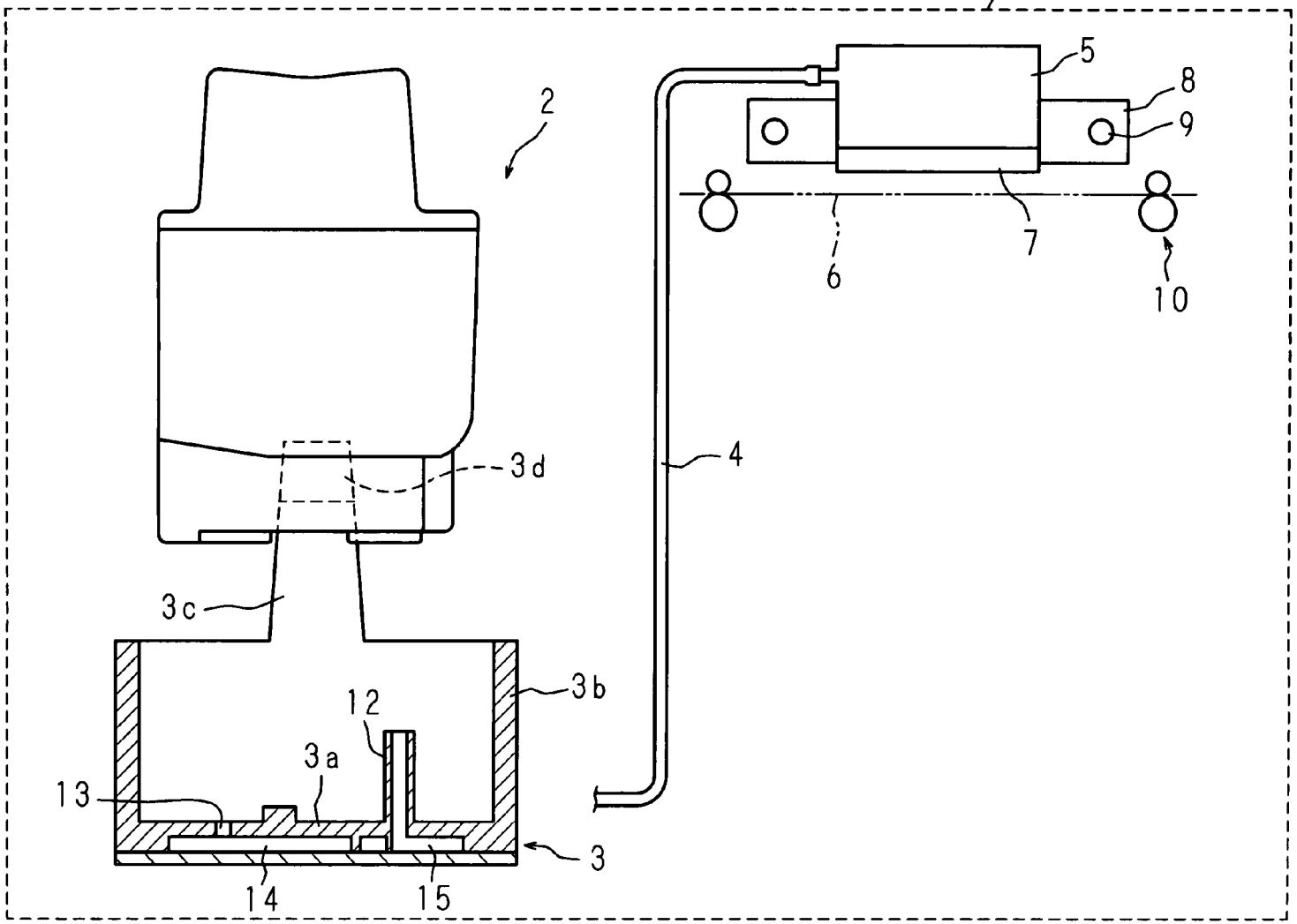
FIG. 1 is a schematic diagram showing a structure of an ink cartridge according to this embodiment.

Hereunder, the present embodiments will be described in details referring to the drawings.

First Embodiment

FIG. 1 is a schematic diagram showing a structure of an ink cartridge according to a first embodiment. In FIG. 1, numeral 1 designates a printer, which includes a cartridge loading unit 3 for mounting an ink cartridge 2 thereon. The ink cartridge 2 is constituted of a substantially rectangular solid-shaped container storing therein printing ink, and though not specifically shown the ink cartridge 2 and the cartridge loading unit 3 are provided for the respective colors of cyan, magenta, yellow and black etc.

The cartridge loading unit 3 includes a substantially rectangular bottom portion 3*a* and a surrounding wall 3*b* erected around the bottom portion 3*a*, so that the ink cartridge 2 can be mounted and stored in the rectangular solid-shaped space defined by the bottom portion 3*a* and the surrounding wall 3*b*. The surrounding wall 3*b* is provided with a trapezoidal plate-shaped arm portion 3*c* extending upward from a generally central portion of one of the sides thereof, and the arm portion 3*c* includes an upper end at which an arm tip portion 3*d* is formed. When the ink cartridge 2 is mounted on the cartridge loading unit 3, the arm portion 3*c* is disposed along a side face of the ink cartridge 2 and the arm tip portion 3*d* formed at the upper end of the arm portion 3*c* is engaged with an upper edge of the ink cartridge 2, so that the ink cartridge 2 is securely attached to the cartridge loading unit 3.

The bottom portion 3*a* includes a cylindrical ink collecting tube 12 projecting upward, and an air supply hole 13 at a position spaced from the ink collecting tube 12 in a longitudinal direction of the bottom portion 3*a*. The ink collecting tube 12 serves to take out the ink out of the ink cartridge 2 and leads the ink to a printer head 7 that includes an ejection nozzle of the ink. The air supply hole 13 communicates with ambient air via a labyrinthine ventilation path 14 provided on the bottom portion 3*a*, so as to introduce air through the ventilation path 14 into the ink cartridge 2.

The bottom portion 3*a* includes an ink path 15 communicating with the ink collecting tube 12, and an ink supply tube 4 is connected to the ink path 15 so that the ink taken out by the ink collecting tube 12 is fed to the ink supply tube 4. The other end of the ink supply tube 4 is connected to an ink tank 5 located in a carriage 8, so that the ink is supplied to the ink tank 5. The ink supplied to the ink tank 5 is ejected to a printing paper 6 through a plurality of ejection nozzles provided in the printer head 7, so as to form a letter, an image or the like on the printing paper 6. The ink tank 5 and the printer head 7 are mounted on the carriage 8, so as to reciprocate together with the carriage 8 along a carriage shaft 9 supporting the carriage 8. The printer 1 also includes a conveying mechanism 10 that conveys the printing paper 6, in a direction orthogonal with respect to the reciprocating direction of the carriage 8.

Figure 2:
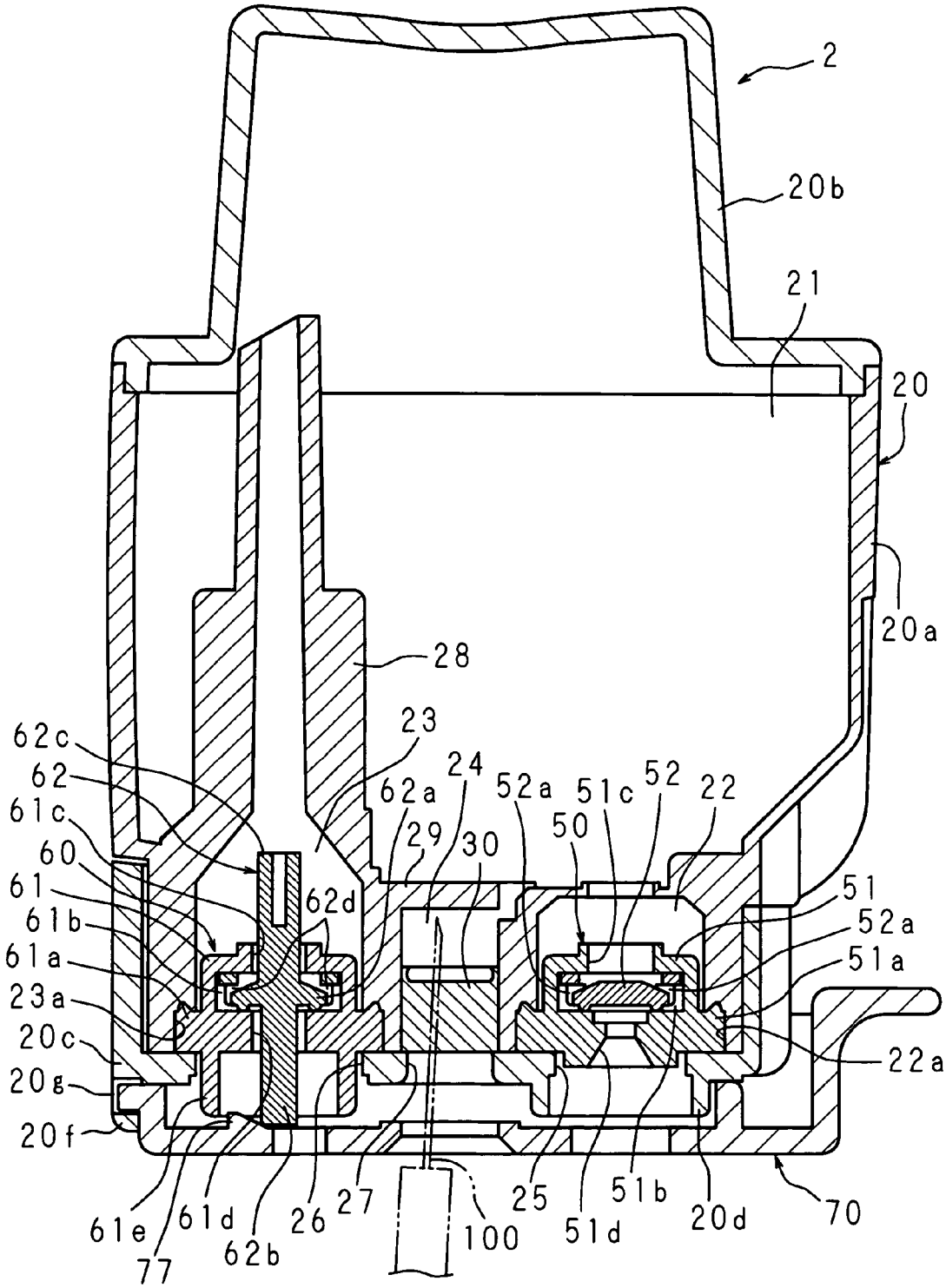
FIG. 2 is a cross-sectional view showing the ink cartridge according to a first embodiment.
Figure 3:
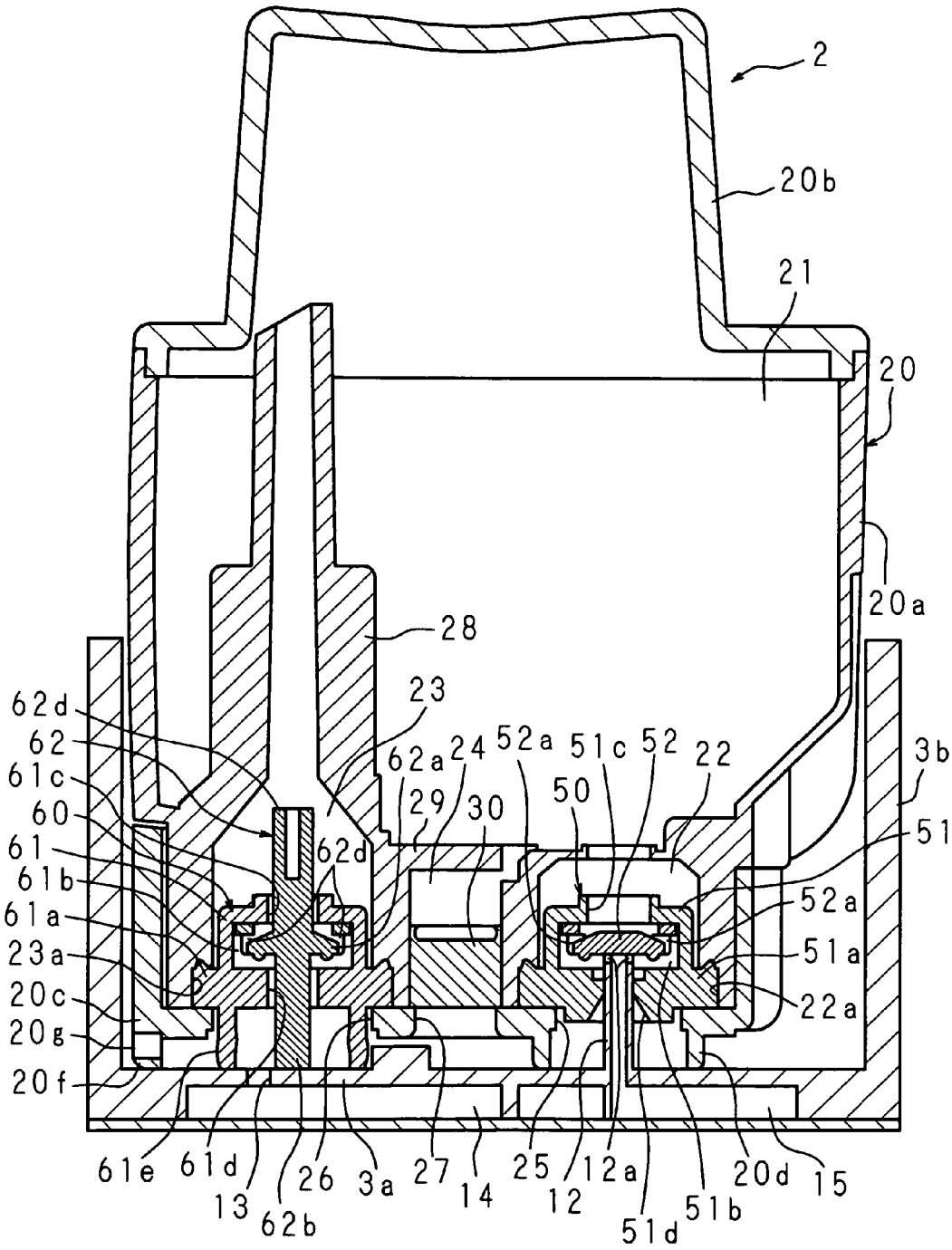
FIG. 3 is a cross-sectional view showing the ink cartridge according to the first embodiment mounted on a cartridge loading unit.

FIG. 2 is a cross-sectional view showing the ink cartridge according to the first embodiment. FIG. 3 is a cross-sectional view showing the ink cartridge according to the first embodiment mounted on a cartridge loading unit. The ink cartridge 2 includes a box-shaped main body 20 in which the ink is loaded, and a protective member 70 that protects the lower face of the main body 20. The main body 20 includes a container portion 20*a*, a cover 20*b* that closes an upper opening of the container portion 20*a*, and a bottom portion 20*c* that covers a lower portion of the container portion 20*a*. The container portion 20*a*, the cover 20*b* and the bottom portion 20*c* are made of a synthetic resin and unified by heat welding or bonding to constitute a casing.

The container portion 20*a* includes therein an ink chamber 21 in which the ink is loaded. The bottom portion 20*c* is of a substantially rectangular shape, and is provided with an ink supply port 25 through which the ink inside the ink chamber 21 is supplied to outside, an ink loading port 27 through which the ink is loaded in the ink chamber 21, and an air intake port 26 through which air is introduced into the ink chamber 21 along with the consumption of the ink, aligned in this sequence in a longitudinal direction of the bottom portion 20*c*. The ink chamber 21 communicates with the ink supply port 25 via an ink supply path 22, with the ink loading port 27 via an ink loading path 24, and with the air intake port 26 via an air intake path 23. The ink supply path 22, the ink loading path 24 and the air intake port 26 are respectively located in a cylindrical wall formed from a bottom wall 29 of the container portion 20*a* toward the bottom portion 20*c*. The bottom portion 20*c* includes a cylindrical protrusion 20*d* protruding out of the ink cartridge 2 so as to surround the ink supply port 25.

The container portion 20*a* also includes a hollow cylindrical portion 28 projecting from the bottom wall 29 toward the upper opening of the ink chamber 21, so as to lead the air introduced through the air intake port 26 and the air intake path 23 to the space above the level of the ink inside the ink chamber 21, through inside the cylindrical portion 28.

Although the ink chamber 21 communicates with outside of the ink cartridge 2 via the ink supply path 22, the ink loading path 24 and the air intake path 23, ink supply path 22 and the air intake path 23 are respectively provided with a valve mechanism to be described later, and the ink loading path 24 is sealed with a stopping member 30 made of an elastic material such as rubber, thus to prevent leakage of the ink in the ink chamber 21.

When loading the ink into the ink chamber 21, a hollow cylindrical ink injection needle 100 is pierced through the stopping member 30 of the ink loading port 27, so as to inject the ink from the ink injection needle 100 into the ink chamber 21, through the ink loading path 24. When the ink injection needle 100 is removed from the stopping member 30 after loading the ink, the stopping member 30 elastically deform so as to close the insertion hole of the ink injection needle 100, thus keeping the ink from leaking through the ink loading port 27.

In the ink supply path 22, a valve mechanism 50 is installed for inhibiting the ink chamber 21 from communicating with outside via the ink supply path 22 and the ink supply port 25. The valve mechanism 50 includes a supporting part 51 made of an elastic material such as rubber, and an ink supply valve 52 made of a synthetic resin. The supporting part 51 is of a cylindrical shape, and includes a mounting portion 51*a* expanded outward from an outer circumferential surface. The ink supply path 22 includes a groove 22*a* formed in a larger diameter on an inner circumferential surface thereof, so that the mounting portion 51*a* fits in the groove 22*a*, thus to fix the valve mechanism 50 in the ink supply path 22 so as to cover the ink supply port 25.

The supporting part 51 encloses therein a columnar valve chamber 51*b* in which the ink supply valve 52 is placed, and includes at an upper end portion thereof a through hole 51*c* smaller in diameter than the valve chamber 51*b*, thus permitting communication between the valve chamber 51*b* and the ink supply path 22. The supporting part 51 also includes at a lower end portion thereof an insertion hole 51*d* tapered so as to downwardly expand, at a position corresponding to the ink supply port 25, thus permitting the valve chamber 51*b* to communicate with outside. The insertion hole 51*d* serves for insertion of the ink collecting tube 12 of the printer 1, and the diameter of the narrowest portion of the insertion hole 51*d* is determined so as to closely contact the outer circumferential surface of the ink collecting tube 12, upon insertion of the same.

The valve chamber 51*b* has a vertical height substantially equal to or slightly lower than the vertical thickness of the ink supply valve 52, so that the peripheral portion of the through hole 51*c* of the supporting part 51 is butted to an upper peripheral portion of the ink supply valve 52 once the ink supply valve 52 is placed in the valve chamber 51*b*, thereby biasing the ink supply valve 52 downward to close the insertion hole 51*d* with the elasticity of the portion constituting the surrounding wall of the valve chamber 51*b* of the supporting part 51. The ink supply valve 52 is provided with a cutaway portion 52*a* along a peripheral portion of the upper surface, which permits communication between the through hole 51*c* and inside of the valve chamber 51*b*. When the ink cartridge 2 is mounted on the cartridge loading unit 3 of the printer 1, as shown in FIG. 3, the ink collecting tube 12 is inserted through the insertion hole 51*d*, so that the tip portion of the ink collecting tube 12 is butted to the ink supply valve 52 thus to lift the ink supply valve 52 upward, which causes the surrounding wall of the valve chamber 51*b* of the supporting part 51 to expand by elastic deformation, thereby causing the ink supply valve 52 to open the insertion hole 51*d*, hence the ink supply port 25. Once this is done, the ink in the ink chamber 21 flows into the valve chamber 51*b* through the ink supply path 22, the through hole 51*c* of the valve mechanism 50 and the cutaway portion 52*a* of the ink supply valve 52, then into the ink collecting tube 12 via a cutaway portion 12*a* formed at the tip thereof, to be led to the ink tank 5 of the printer 1.

In the air intake path 23, a valve mechanism 60 is installed for inhibiting the ink chamber 21 from communicating with outside via the air intake path 23 and the air intake port 26. The valve mechanism 60 has substantially the same structure as the valve mechanism 50 provided in the ink supply path 22, and includes a supporting part 61 made of an elastic material such as rubber, and an air intake valve 62 made of a synthetic resin. The supporting part 61 is of a cylindrical shape, and includes a mounting portion 61*a* expanded outward from an outer circumferential surface. The air intake path 23 includes a groove 23*a* formed in a larger diameter on an inner circumferential surface thereof, so that the mounting portion 61*a* fits in the groove 23*a*, thus to fix the valve mechanism 60 in the air intake path 23 so as to cover the air intake port 26.

The supporting part 61 encloses therein a columnar valve chamber 61*b* in which the air intake valve 62 is placed. The air intake valve 62 includes a disc-shaped valve body 62*a*, a columnar projection 62*c* projecting upward from an upper face of the valve body 62*a*, and a manipulating rod (valve opening portion) 62*b* projecting downward from a lower face of the valve body 62*a*. The columnar projection 62*c* projecting from the valve body 62*a* sticks through and beyond a through hole 61*c* provided at an upper end portion of the supporting part 61. The outer circumferential surface of the columnar projection 62*c* and the inner circumferential surface of the through hole 61*c* define a sufficient gap for air to pass through, thus permitting the through hole 61*c* to communicate with the valve chamber 61*b* via a cutaway portion 62*d* provided along an upper peripheral portion of the valve body 62*a*, with a peripheral portion of the through hole 61*c* butted to the upper peripheral portion of the valve body 62*a*, like the valve mechanism 50 on the ink supply side.

The manipulating rod 62*b* sticks from the valve chamber 61*b* beyond a through hole 61*d* provided at a lower end portion of the supporting part 61, so as to protrude out of the ink cartridge 2 through the air intake port 26. The through hole 61*d* is slightly larger in diameter than the manipulating rod 62*b*, and hence a gap is secured therebetween. The supporting part 61 includes at a lower end portion thereof a cylindrical sealing portion 61*e* that surrounds the manipulating rod 62*b*, and the sealing portion 61*e* also protrudes out of the ink cartridge 2 through the air intake port 62, like the manipulating rod 62*b*.

The valve body 62*a* of the air intake valve 62 is, as in the valve mechanism 50 on the ink supply side, biased to close the through hole 61*d* by the supporting part 61, which is made of an elastic material. When the ink cartridge 2 is mounted on the cartridge loading unit 3 of the printer 1, as shown in FIG. 3, the tip portion of the manipulating rod 62*b* is butted to the bottom portion 3*a* of the cartridge loading unit 3 thus to be lifted upward, thus to expand the surrounding wall of the valve chamber 61*b* of the supporting part 61 by elastic deformation, thereby causing the air intake valve 62 to open the through hole 61*d*. At the same time the end portion of the sealing portion 61*e* surrounding the manipulating rod 62*b* is butted to the bottom portion of the cartridge loading unit 3 thus to seal the outer circumference of the manipulating rod 62*b*, thereby permitting only the air taken in through the air supply hole 13 of the cartridge loading unit 3 to flow into the ink cartridge 2.

When the air intake valve 62 opens the through hole 61*d* upon mounting the ink cartridge 2 on the cartridge loading unit 3, the air taken in through the air supply hole 13 of the cartridge loading unit 3 is led to the valve chamber 61*b* via the through hole 61*c* of the valve mechanism 60, then to the air intake path 23 through a cutaway portion 62*d* of the valve body 62*a* and the through hole 61*c*, to be introduced into an upper portion of the ink chamber 21 through the cylindrical portion 28.

Figure 4:
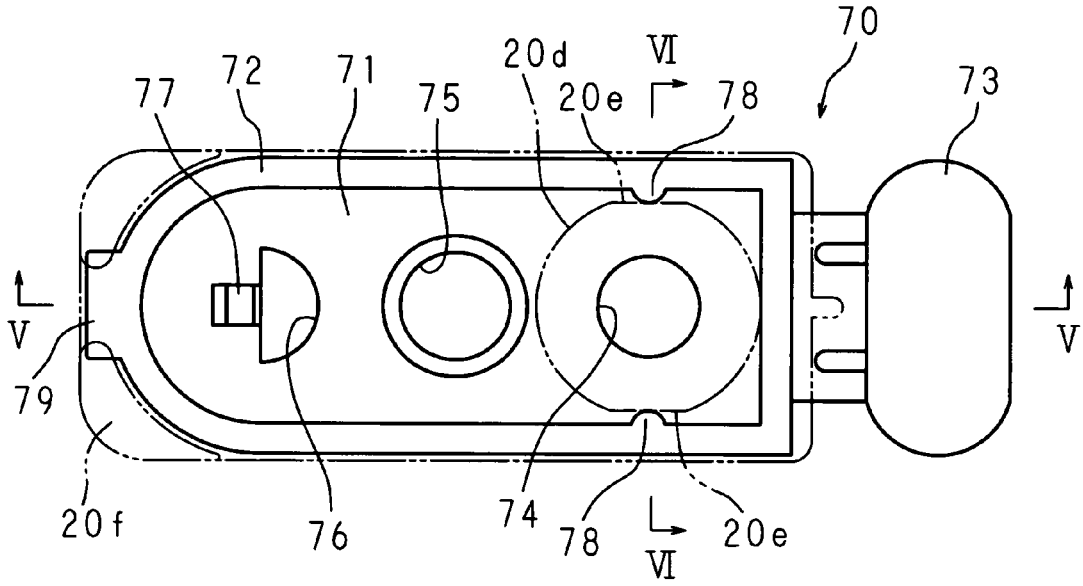
FIG. 4 is a plan view showing a protective member according to the first embodiment.
Figure 5:
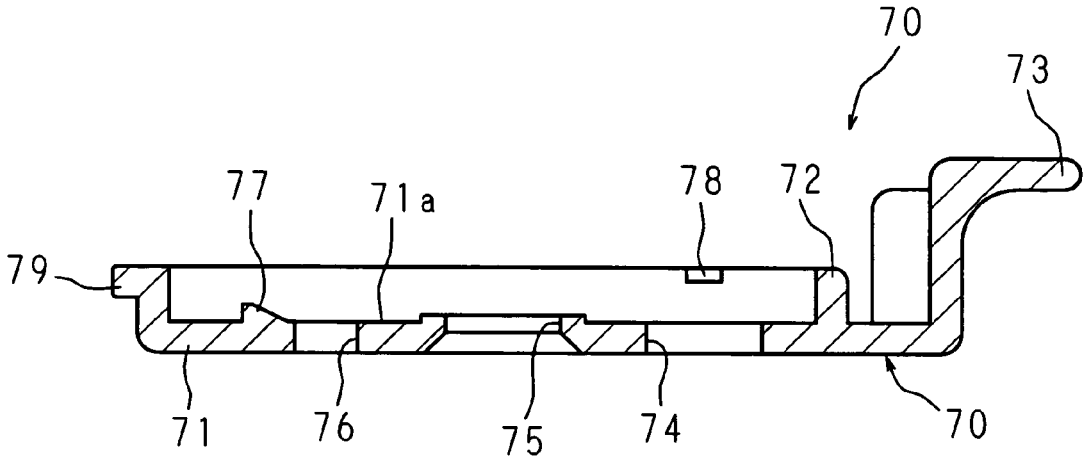
FIG. 5 is a cross-sectional view taken along the line V-V of FIG. 4.
Figure 6:
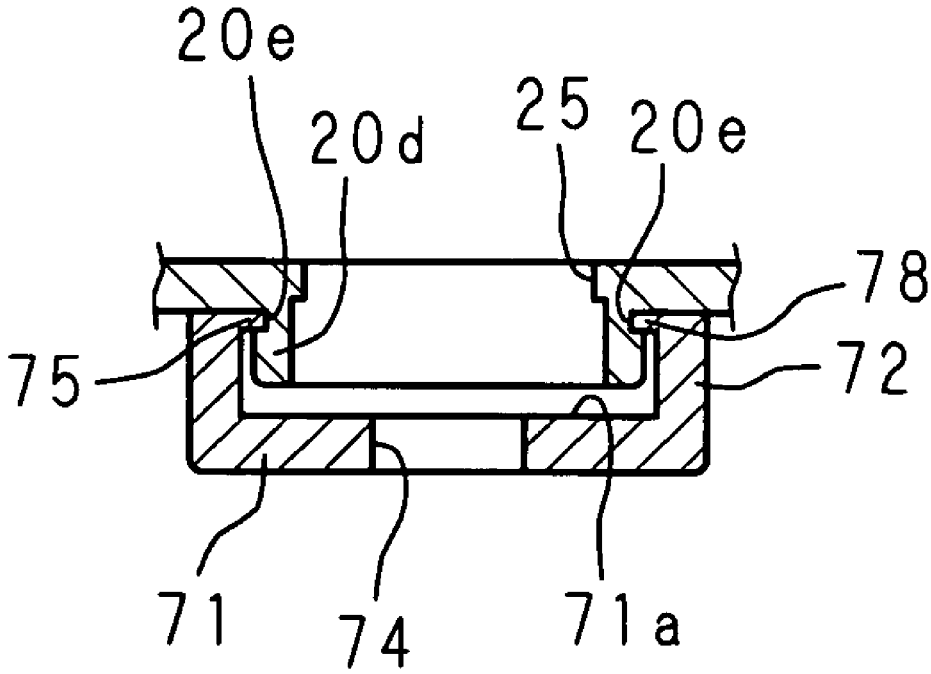
FIG. 6 is a cross-sectional view taken along the line VI-VI of FIG. 4.
Figure 7:
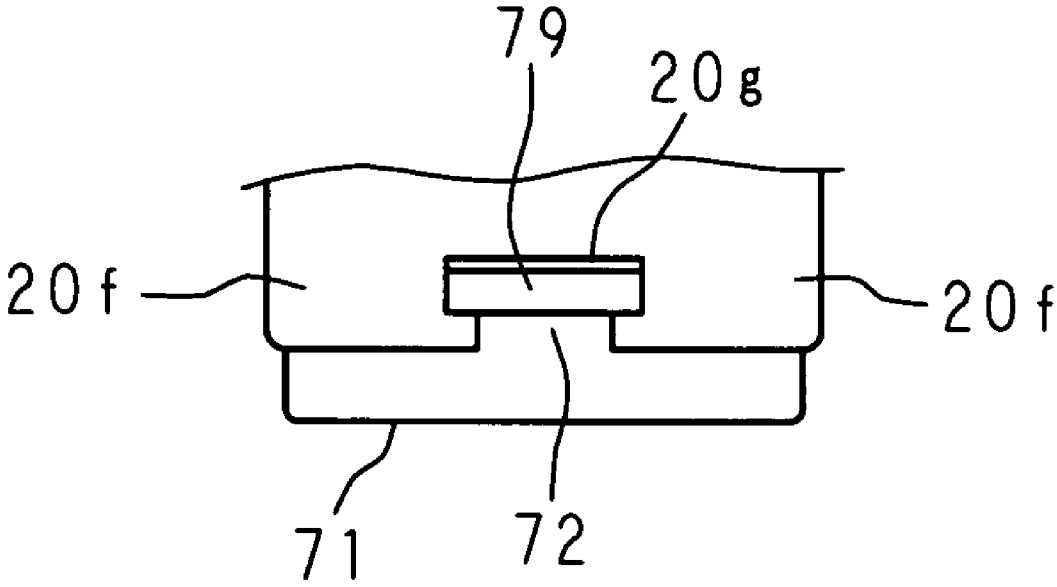
FIG. 7 is a side view showing the protective member according to the first embodiment.

The ink cartridge 2 includes the protective member 70 that covers and protects the ink supply port 25, the air intake port 26 and the ink loading port 27 on the bottom portion 20*c*, to keep a user from directly touching these portions. FIG. 4 is a plan view showing the protective member 70 according to the first embodiment. FIG. 5 is a cross-sectional view taken along the line V-V of FIG. 4, and FIG. 6 is a cross-sectional view taken along the line VI-VI of FIG. 4. FIG. 7 is a side view showing the protective member 70 according to the first embodiment. In FIG. 4, the profile of the ink cartridge 2 formed when the protective member 70 is attached to the ink cartridge 2 is partly delineated by a double-dotted dashed line.

The protective member 70 is of a rectangular shape having substantially the same plan-view shape as the bottom portion 20*c* of the ink cartridge 2, and includes a base plate portion 71 with one end portion formed in a substantially arc shape, a surrounding wall 72 erected so as to surround the base plate portion 71, and a lug portion 73 extended from the other end portion of the base plate portion 71. The base plate portion 71, the surrounding wall 72 and the lug portion 73 are integrally formed of a synthetic resin.

The protective member 70 is attached to the ink cartridge 2 with the base plate portion 71 of the protective member 70 located to oppose the bottom portion 20*c* of the ink cartridge 2, and the base plate portion 71 includes a first check hole 74, a second check hole 75 and a third check hole 76 respectively located so as to correspond to the ink supply port 25, the ink loading port 27 and the air intake port 26. The first check hole 74 and the second check hole 75 are of a circular shape, while the third check hole 76 is of a semicircular shape. In other words, the first check hole 74, the second check hole 75 and the third check hole 76 are aligned in this sequence in a direction from the end portion where the lug portion 73 is provided toward the arc-shaped end portion. These check holes allows confirming the attached status of the stopping member 30, the valve mechanism 50 and the valve mechanism 60 to the ink supply port 25, the ink loading port 27 and the air intake port 26, respectively without detaching the protective member 70 after attaching the protective member 70 to the ink cartridge 2.

The protective member 70 includes a projection (valve opening portion) 77 close to the straight portion of the semicircular third check hole 76, on the surface 71*a* of the base plate portion 71 that faces the bottom portion 20*c* of the ink cartridge 2 when the protective member 70 is attached thereto. The projection 77 is of a substantially wedge shape with a face inclined in a direction from the arc-shaped end portion toward the lug portion 73 of the base plate portion 71. Under such structure, the tip portion of the manipulating rod 62*b* protruding from the air intake port 26 is located close to a lower portion of the inclined face of the projection 77, when the protective member 70 is attached to the ink cartridge 2.

The surrounding wall 72 is provided with inner nail portions (nail portions) 78, 78 respectively protruding inward so as to oppose each other across the first check hole 74, from an upper portion of the inner surface of the longer sides thereof. Also, the protrusion 20*d* on the bottom portion 20*c* of the ink cartridge 2 includes sliding grooves 20*e*, 20*e* formed on both sides thereof in a longitudinal direction of the bottom portion 20*c*.

The arc-shaped end portion of the surrounding wall 72 is provided with an outer nail portion 79 protruding outward, i.e. parallel to the sliding groove 20*e*. The bottom portion 20*c* of the ink cartridge 2 includes a pair of locking walls 20*f*, 20*f* protruding in the same direction as the protruding direction of the manipulating rod 62*b* from the shorter side closer to the air intake port 26, so as to block the movement of the protective member 70 in the longitudinal direction of the bottom portion 20*c*. To the locking walls 20*f*, 20*f* serves to inhibit further movement of the protective member 70, once the arc-shaped portion of the surrounding wall 72 of the protective member 70 is butted thereto. Accordingly, the surface of the locking walls 20*f*, 20*f* to be in contact with the surrounding wall 72 is curved. Between the locking walls 20*f*, 20*f*, a nail engaging portion 20*g* having an opening parallel to the sliding groove 20*e* is provided, for engagement with the outer nail portion 79 of the protective member 70. Applying the protective member 70 to the bottom portion 20*c* and sliding the same in a longitudinal direction achieves slide-engagement between the outer nail portion 79 and the nail engaging portion 20*g*, as well as between the inner nail portions 78, 78 and the sliding grooves 20*e*, 20*e*, thereby completing the attachment of the protective member 70 to the ink cartridge 2. Once this is done, the protective member 70 is inhibited from moving in a projecting direction of the manipulating rod 62*b*, i.e. vertically downward to be separated from the lower face of the bottom portion 20*c*, as well as from moving further forward by the locking walls 20*f*, 20*f* To remove the protective member 70 from the ink cartridge 2, the protective member 70 may be slided so as to be separated from the locking walls 20*f*, 20*f* until the outer nail portion 79 is disengaged with the nail engaging portion 20*g*, and the inner nail portions 78, 78 from the sliding grooves 20*e*, 20*e* respectively, and then separated from the lower face of the bottom portion 20*c* vertically downward.

Figure 8:
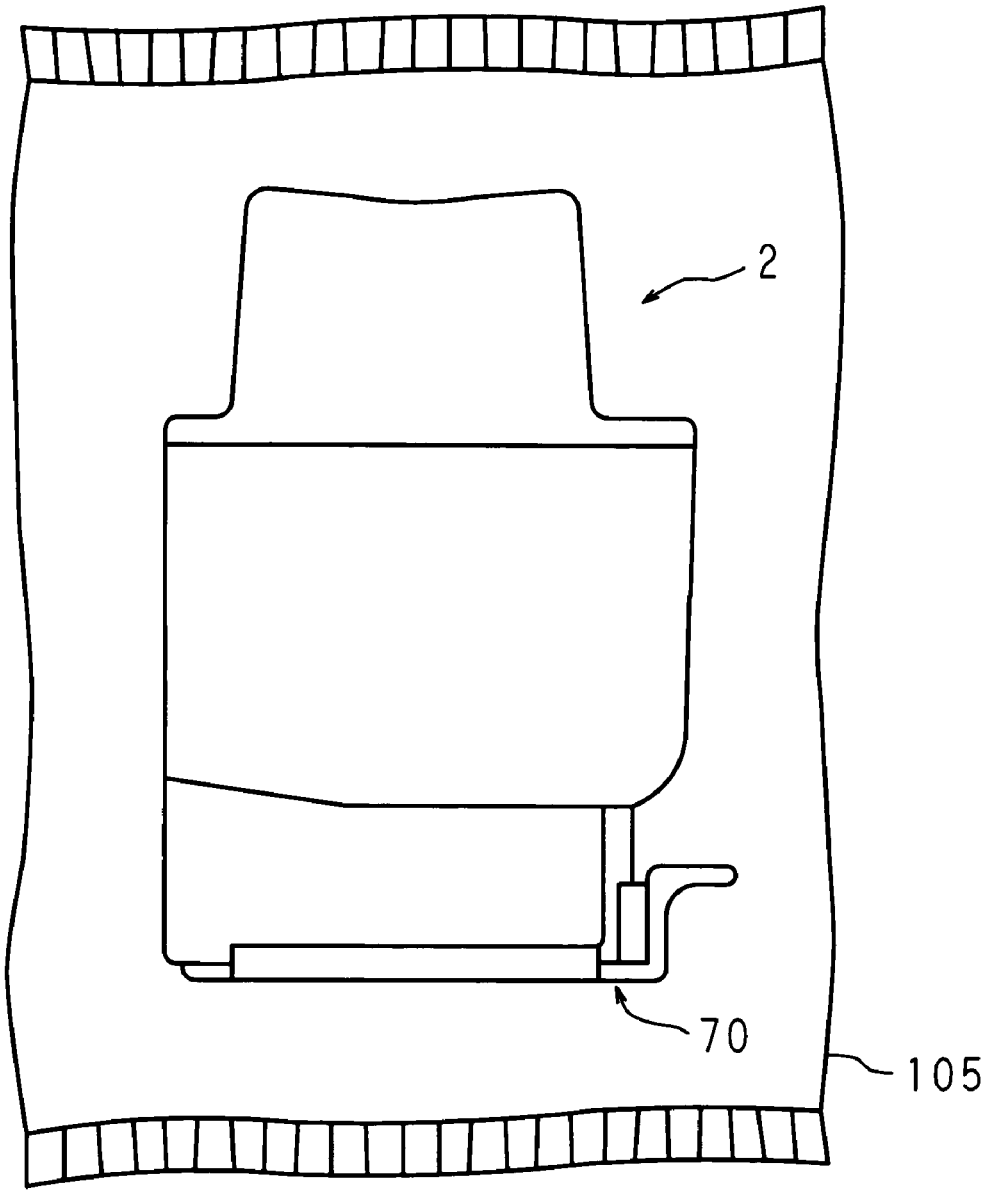
FIG. 8 is a schematic drawing showing the ink cartridge according to this embodiment contained in a containing material.

When loading the ink in the ink chamber 21 in the ink cartridge 2 thus configured, a vacuum pump (not shown) is connected through the first check hole 74 and the ink supply port 25 to the ink cartridge 2 with the protective member 70 attached, and the valve mechanism 50 is opened so as to discharge the air from inside the ink cartridge 2. Then the hollow ink injection needle 100 is pierced through the stopping member 30 via the second check hole 75 and the ink loading port 27, so as to inject the ink through the ink injection needle 100 into the ink chamber 21. After the ink has been loaded, the ink cartridge 2 is placed in a containing material 105 (Ref. FIG. 8), and the air inside the containing material 105 is discharged, thus achieving a vacuum package.

FIG. 8 is a schematic drawing showing the ink cartridge according to this embodiment, contained in a containing material. In FIG. 8 the numeral 105 designates the containing material, which is a bag-shaped material in which the ink cartridge 2 with the protective member 70 attached is to be contained. The containing material 105 is made of a non-air-permeable resin film, which enables discharging the air from the containing material 105 after placing the ink cartridge 2 therein for depressurization, to thus achieve a vacuum package. A purpose of the vacuum packaging is to keep the ink in the ink cartridge 2 deaerated.

When replacing the ink cartridge 2 of the printer 1, the user takes out the ink cartridge from the vacuum package, and removes the protective member 70 covering the ink supply port 25, the air intake port 26 or the like, from the main body 20 of the ink cartridge 2 in the foregoing manner.

Figure 9:
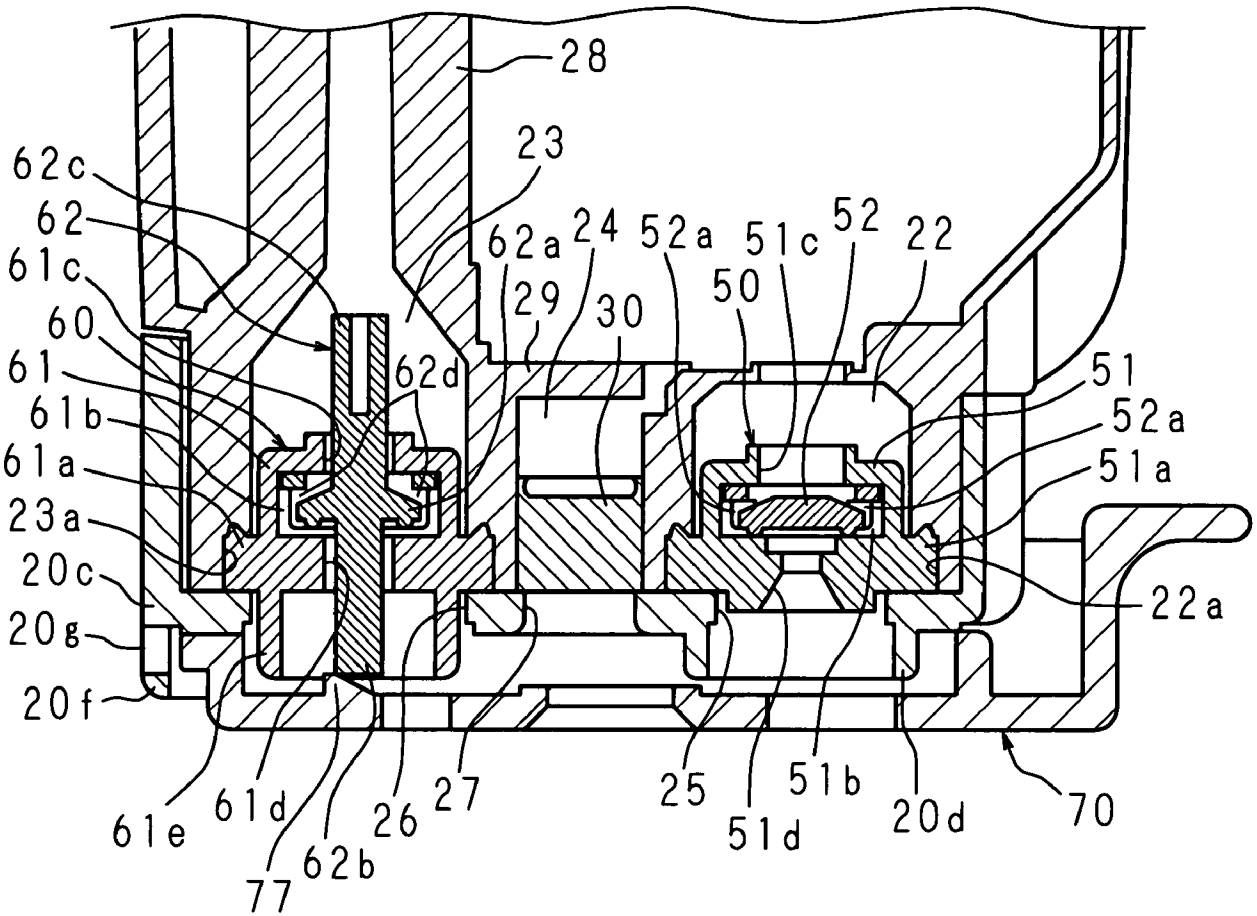
FIG. 9 is an enlarged cross-sectional view showing the protective member being removed from the ink cartridge according to the first embodiment.

FIG. 9 is an enlarged cross-sectional view showing the protective member 70 being removed from the ink cartridge 2 according to the first embodiment. When the protective member 70 is slid for removal, the tip portion of the manipulating rod 62*b* is butted to the inclined surface of the projection 77 formed on the base plate portion 71 of the protective member 70, so that the manipulating rod 62*b* moves, along with the sliding motion of the protective member 70, toward an inner deeper portion of the air intake path 23 along the inclined surface of the projection 77. This causes the valve body of the valve mechanism 60 to open, to thereby introduce air into the ink chamber 21, which has been depressurized after the vacuum packaging.

At this stage, even though the ink has intruded into the air intake path 23 because of a falldown of the ink cartridge 2 during transportation or the like, the ink is returned to the ink chamber 21 once the air intake valve 62 is opened, because of a difference in pressure between the ambient air and inside of the ink chamber 21. Here, although the air intake valve 62 is only temporarily opened until the protective member 70 is separated from the bottom portion 20*c* after the sliding motion, this is sufficient for securing an atmospheric pressure in the ink chamber 21.

A reason that the foregoing motion of the protective member 70 keeps the ink supply valve 52 closed is that, while the ink chamber 21 is depressurized, opening the ink supply valve 52 may provoke formation of a air bubble mass from the air that intrudes through the ink supply valve 25, close to the valve mechanism 50, thus disturbing the ink supply to the ink collecting tube 12.

Since air is introduced into the ink chamber 21 upon removal of the protective member 70 when replacing the ink cartridge 2, the atmospheric pressure is secured in the ink chamber 21 by the time that the ink cartridge 2 is mounted on the cartridge loading unit 3 of the printer 1. Accordingly, though the ink collecting tube 12 opens the ink supply valve 52, the ink loaded in the ink collecting tube 12 and the ink path 15 can be kept from flowing backward to the ink chamber 21, and hence the meniscus in the ejection nozzles of the printer head 7 is protected from being destroyed thus preventing defective ejection.

It is to be noted that, while the protective member 70 is slid in the longitudinal direction for removal from the ink cartridge 2 in this embodiment, the protective member 70 may be configured to be moved in a different direction for removal.

Second Embodiment

While the protective member 70 is slid for removal from the ink cartridge 2 according to the first embodiment, in a second embodiment, the protective member is configured to be removed from the ink cartridge 2 by a swinging motion. The main body 20 of the ink cartridge 2 according to the second embodiment has substantially the same structure as that of the first embodiment, except for a difference in the structure of the valve mechanism provided in the air intake path 23. The valve mechanism provided in the air intake path 23 of the ink cartridge 2 according to the second embodiment has the same structure as that of the valve mechanism 50 provided in the ink supply path 22. The valve mechanism on the ink supply side in the second embodiment is the same as the valve mechanism on the ink supply side in the first embodiment.

Figure 10:
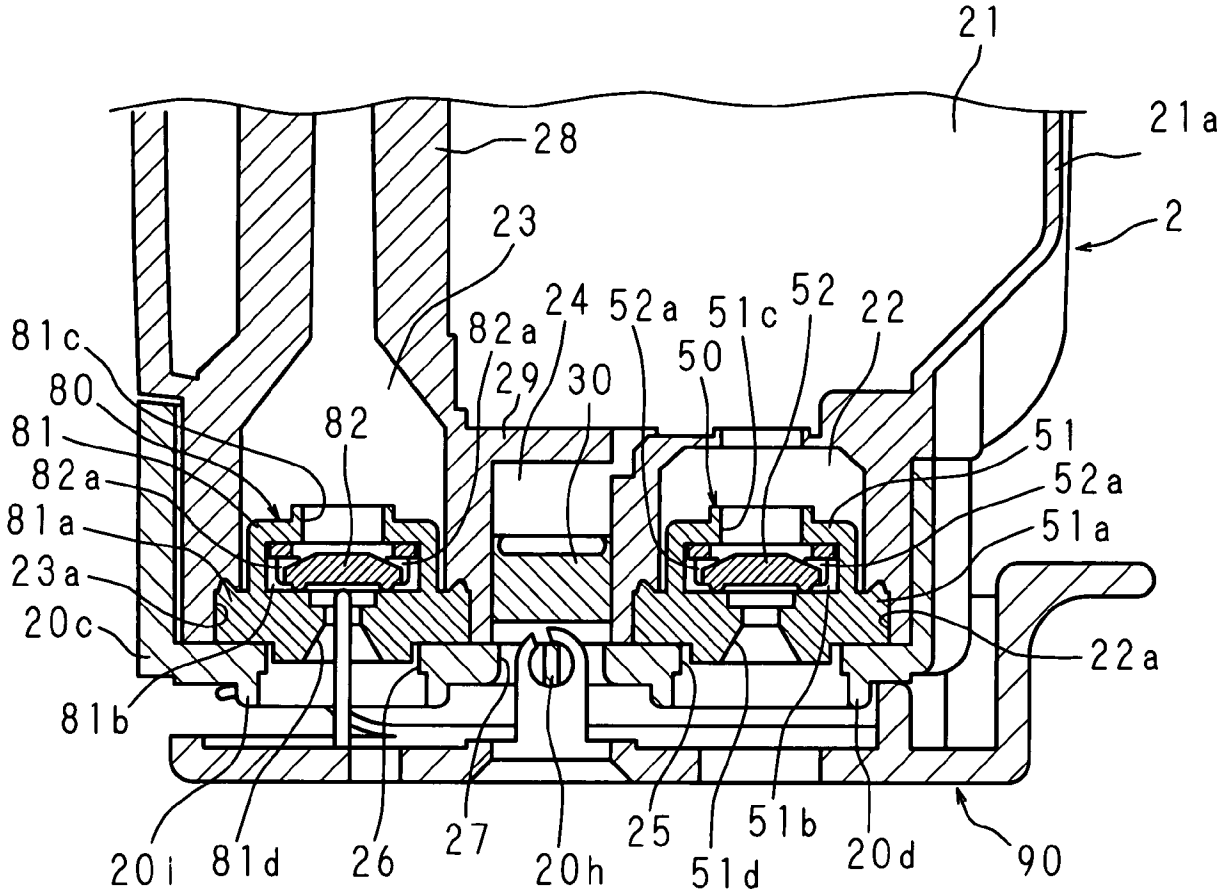
FIG. 10 is an enlarged cross-sectional view showing the protective member attached to the ink cartridge according to a second embodiment.
Figure 11:
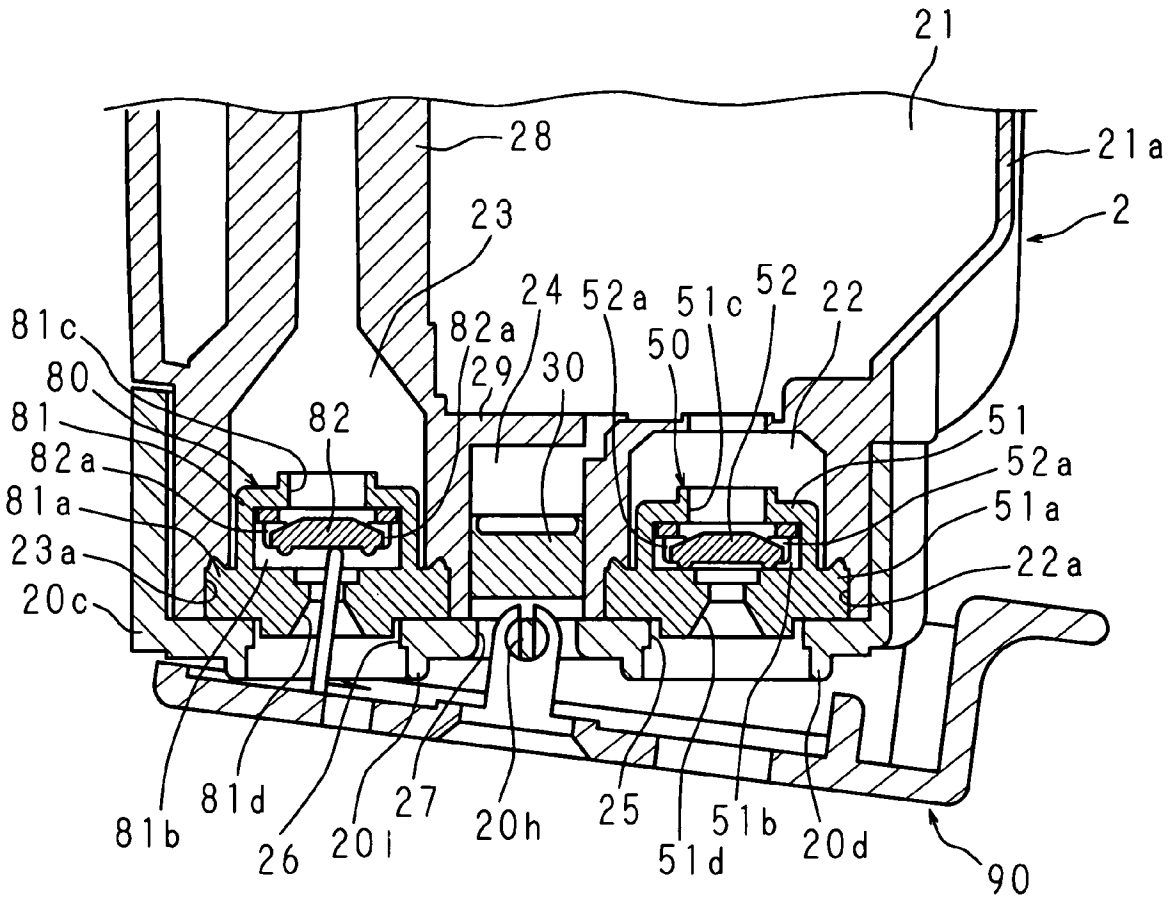
FIG. 11 is an enlarged cross-sectional view showing the protective member under a swinging motion for removal from the ink cartridge according to the second embodiment.
Figure 12:
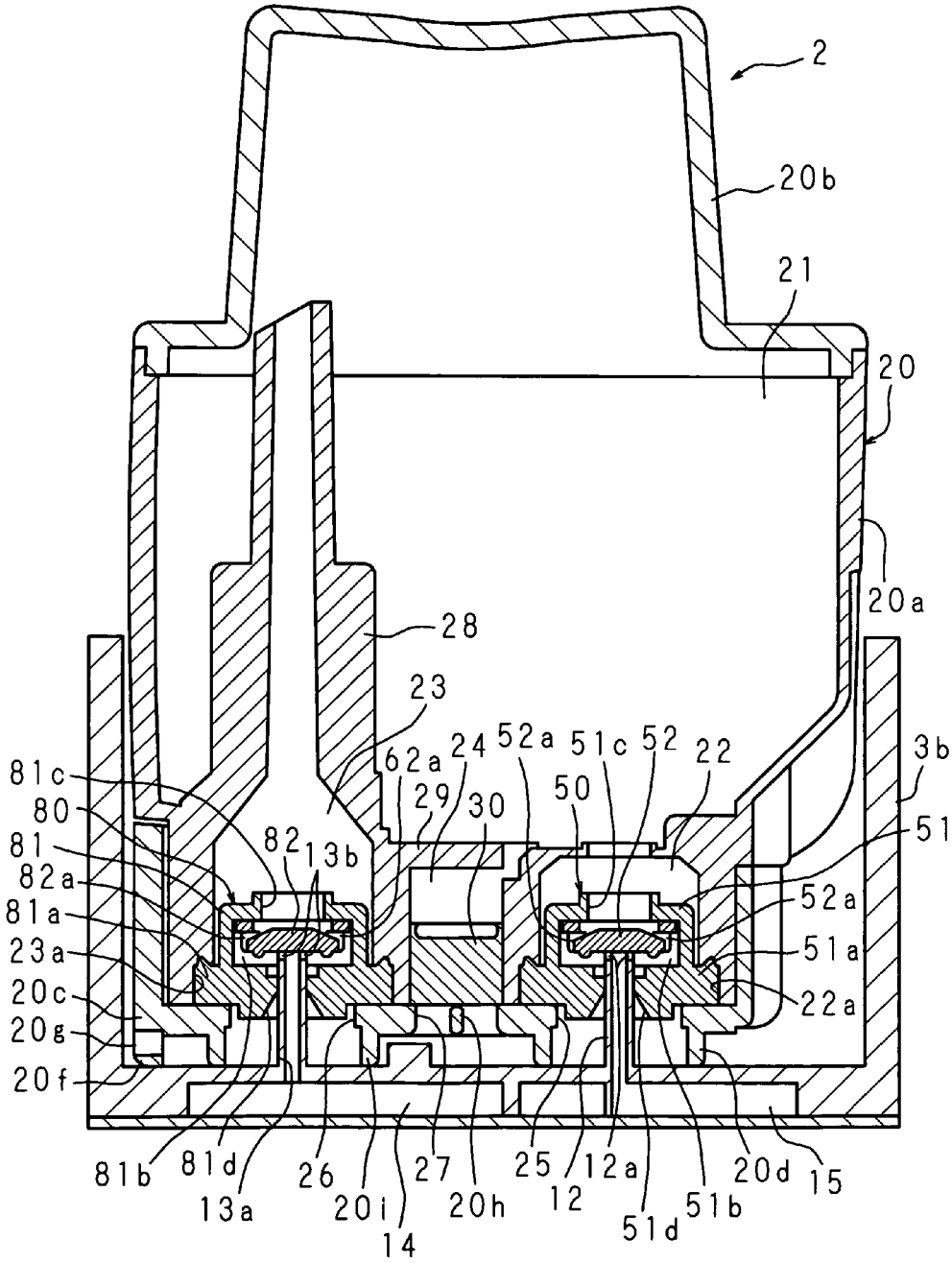
FIG. 12 is a cross-sectional view showing the ink cartridge according to the second embodiment mounted on the cartridge loading unit.

FIG. 10 is an enlarged cross-sectional view showing the protective member attached to the ink cartridge according to the second embodiment. FIG. 11 is an enlarged cross-sectional view showing the protective member under a swinging motion for removal from the ink cartridge according to the second embodiment. FIG. 12 is a cross-sectional view showing the ink cartridge according to the second embodiment mounted on the cartridge loading unit 3.

In FIG. 12, the numeral 80 designates a valve mechanism that opens and closes the air intake path 23, and the valve mechanism 80 includes a supporting part 81 made of an elastic material such as rubber, and an air intake valve 82 made of a synthetic resin. The supporting part 81 is of a cylindrical shape, and includes a mounting portion 81*a* expanded outward from an outer circumferential surface. The air intake path 23 includes a groove 23*a* formed in a larger diameter on an inner circumferential surface thereof, so that the mounting portion 81*a* fits in the groove 23*a*, thus to fix the valve mechanism 80 in the air intake path 23. The supporting part 81 encloses therein a columnar valve chamber 81*b* in which the air intake valve 82 is placed, and includes a through hole 81*c* at an upper end portion thereof, and a tapered insertion hole 81*d* at a lower end portion thereof The valve chamber 81*b* communicates with the ink chamber 21 via the through hole 81*c*, and with outside via the insertion hole 81*d*.

The air intake valve 82 placed in the valve chamber 81*b* is, as in the valve mechanism of the first embodiment, biased to close the insertion hole 81*d* by the elasticity of the supporting part 81. The air intake valve 82 is provided with a cutaway portion 82*a* at an upper portion thereof, which permits communication between the air intake path 23 and the valve chamber 81*b*, via the through hole 81*c* and the cutaway portion 82*a*.

The bottom portion 3*a* of the cartridge loading unit 3 of the printer 1 includes an air supply tube 13*a* projecting upward for introducing air into the ink cartridge 2 therethrough, by the side of the ink collecting tube 12 for taking out the ink from the ink cartridge 2, and the air supply tube 13*a* has a cutaway portion 13*b* at its tip portion. When the ink cartridge 2 is mounted on the cartridge loading unit 3 of the printer 1, the air supply tube 13*a* is inserted through the insertion hole 81*d*, so that the tip portion of the air supply tube 13*a* is butted to the air intake valve 82 thus to lift the air intake valve 82 upward, which causes a surrounding wall portion of the valve chamber 81*b* of the supporting part 81 to expand by elastic deformation, thereby causing the air intake valve 82 to open the insertion hole 81*d*, hence the air intake port 26. Once this is done, air is introduced into the valve chamber 81*b* through inside the air supply tube 13*a* and the cutaway portion 13*b* thereof, then into the air intake path 23, thus to be led to an upper portion of the ink chamber 21 through the cylindrical portion 28.

The ink cartridge 2 also includes a support shaft 20*h* in the ink loading port 27, bridged between opposing inner surfaces of the ink loading port 27 orthogonally to a longitudinal direction of the bottom portion 20*c* of the ink cartridge 2. The support shaft 20*h* is of a plate shape having a rectangular cross-section, with the side surface of the cross-section vertically oriented from the opening of the ink loading port 27.

Also, the bottom portion 20*c* of the ink cartridge 2 is provided with a cylindrical protrusion 20*i* protruding outward so as to surround the air intake port 26. The protrusion 20*i* is of the same shape as the protrusion 20*d* provided around the ink supply port 25.

Figure 13:
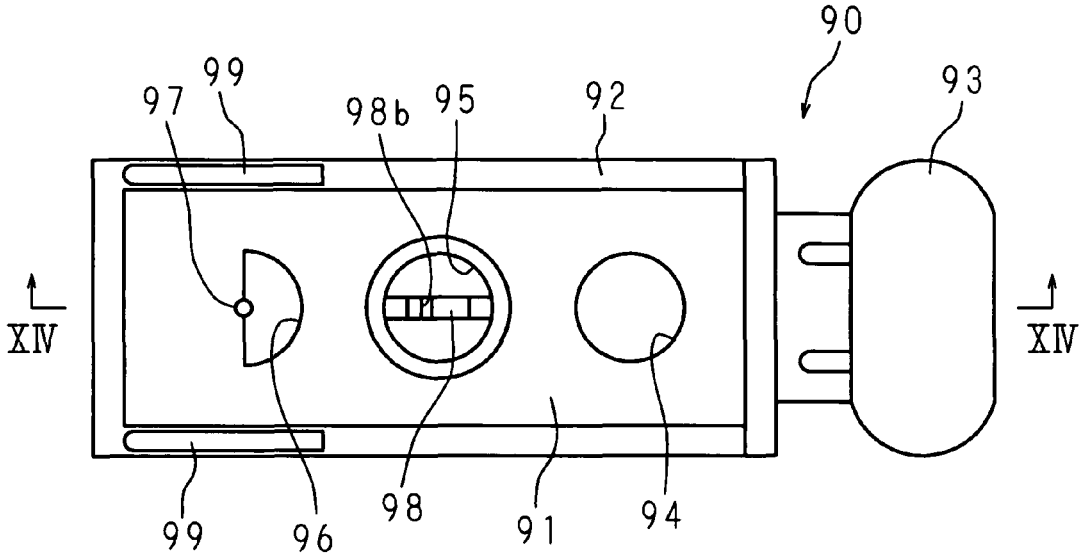
FIG. 13 is a plan view showing a protective member of the ink cartridge according to the second embodiment.
Figure 14:
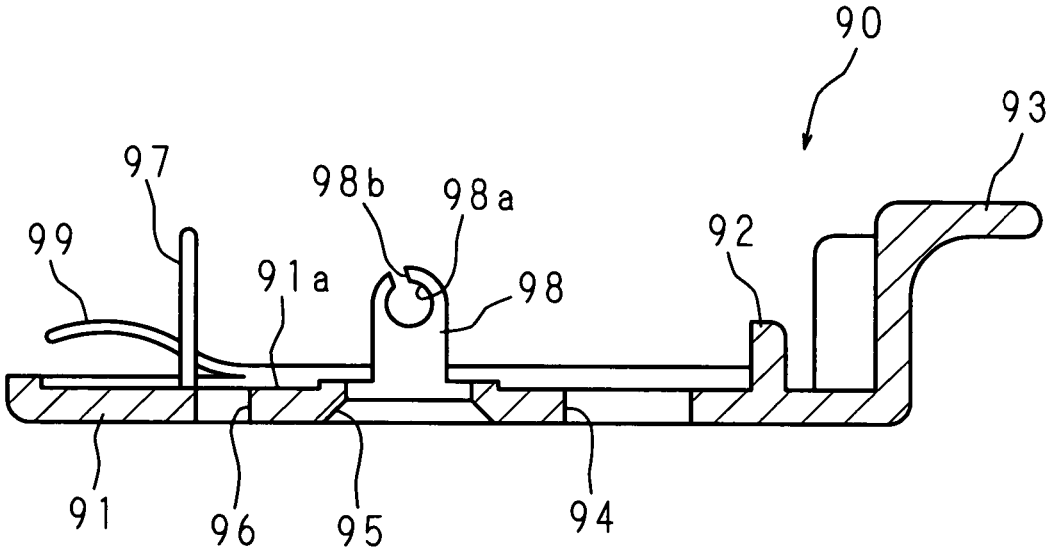
FIG. 14 is a cross-sectional view taken along the line XIV-XIV of FIG. 12.
Figure 15A:
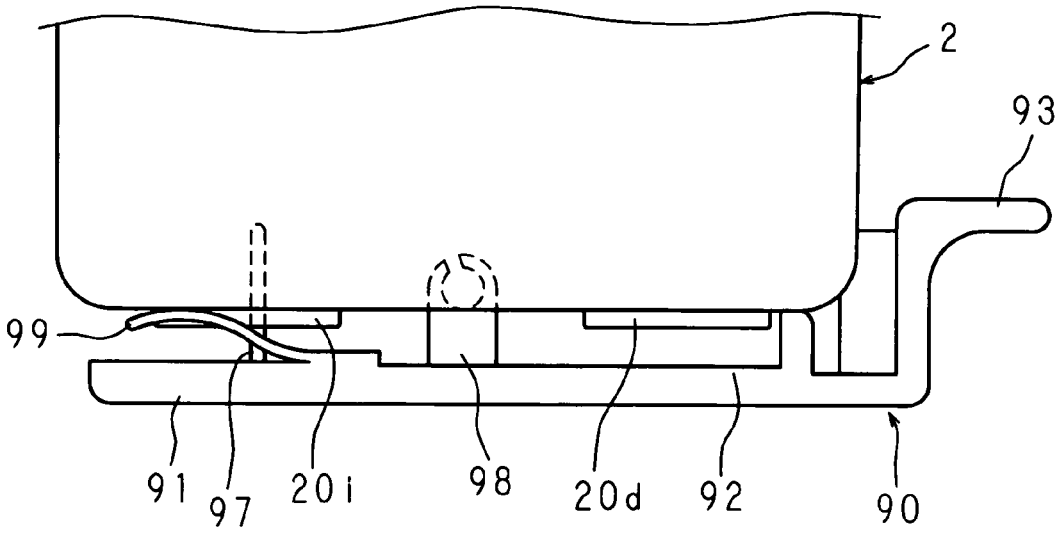
FIGS. 15A and 15B are side views showing the protective member attached to the ink cartridge according to the second embodiment.
Figure 15B:
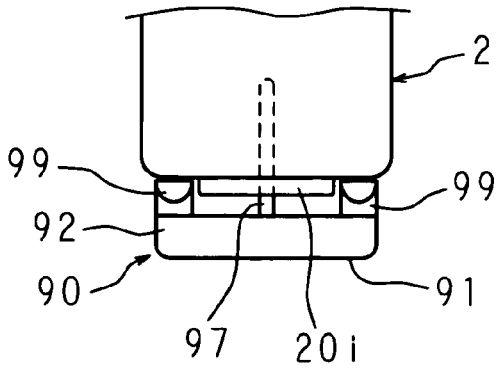

FIG. 13 is a plan view showing a protective member 90 of the ink cartridge 2 according to the second embodiment, and FIG. 14 is a cross-sectional view taken along the line XIV-XIV of FIG. 13. FIGS. 15A and 15B are side views showing the protective member 90 attached to the ink cartridge 2 according to the second embodiment. FIG. 15A is a side view along a longitudinal direction of the protective member 90, while FIG. 15B is a side view along a widthwise direction thereof, from the side of the air intake port 26.

The protective member 90 includes a rectangular base plate portion 91, a surrounding wall 92 erected so as to surround the base plate portion 91, and a lug portion 93 extended from a shorter side of the base plate portion 91. The shorter side of the surrounding wall 92 closer to the lug portion 93 is slightly higher than other sides. The base plate portion 91, the surrounding portion 92 and the lug portion 93 are integrally formed of a synthetic resin.

The protective member 90 is attached to the ink cartridge 2 with the base plate portion 91 of the protective member 90 located to oppose the bottom portion 20*c* of the ink cartridge 2, and the base plate portion 91 includes a first check hole 94, a second check hole 95 and a third check hole 96 respectively located so as to correspond to the ink supply port 25, the ink loading port 27 and the air intake port 26. The first check hole 94 and the second check hole 95 are of a circular shape, while the third check hole 96 is of a semicircular shape. In other words, the first check hole 94, the second check hole 95 and the third check hole 96 are aligned in this sequence, in a direction from the end portion where the lug portion 93 is provided toward the other end portion.

The protective member 90 includes a columnar manipulating rod (valve opening portion) 97 substantially vertically projecting from a position close to the straight portion of the semicircular third check hole 96, on the surface 91*a* of the base plate portion 91 that faces the bottom portion 20*c* of the ink cartridge 2 when the protective member 90 is attached thereto. The manipulating rod 97 is inserted into the insertion hole 81*d* of the valve mechanism 80 through the air intake port 26, when the protective member 90 is attached to the ink cartridge 2. The manipulating rod 97 is smaller in diameter than the insertion hole 81*d*, and has a length that keeps the manipulating rod 97 from contacting the air intake valve 82 of the valve mechanism 80, when the protective member 90 is attached to the ink cartridge 2 thus to insert the manipulating rod 97 into the insertion hole 81*d*.

The second check hole 95 includes a plate-shaped protrusion engaging portion 98, bridged between opposing inner surfaces of the hole in a longitudinal direction of the base plate portion 91 and projecting along the sticking direction of the manipulating rod 97. The protrusion engaging portion 98 includes a circular engaging hole 98*a*, and a cutaway portion 98*b* formed at an upper end portion of the protrusion engaging portion 98 so as to permit communication between inside and outside of the engaging hole 98*a*. The cutaway portion 98*b* is located at a position inclined by 30 to 45 degrees toward the manipulating rod 97, with respect to the projecting direction of the protrusion engaging portion 98. The protrusion engaging portion 98 serves for engagement with the support shaft 20*h* of the ink cartridge 2, and the engaging hole 98*a* has a diameter substantially the same as the longer side of the rectangular cross-section of the support shaft 20*h*, and the cutaway portion 98*b* has a width substantially the same as the shorter side of the cross-section of the support shaft 20*h*. Such configuration limits a direction that allows the support shaft 20*h* to get engaged or disengaged with the engaging hole 98*a* through the cutaway portion 98*b*, thus keeping the support shaft 20*h* from being accidentally disengaged from the engaging hole 98*a*.

The surrounding wall 92 is provided with biasing portions 99, 99 disposed on an upper portion of the longer sides thereof, so as to oppose each other across the third check hole 96. The biasing portions 99, 99 are plate-shaped and curved leaf springs made of a synthetic resin, and respectively butted to the bottom portion 22*c* on both outer sides of the protrusion 20*i* of the ink cartridge 2, when the protective member 90 is attached thereto.

To attach the protective member 90 to the ink cartridge 2, the protective member 90 is brought close to the ink cartridge 2 with the base plate portion 91 of the protective member 90 oriented so as to oppose the bottom portion 20*c* of the ink cartridge 2, and the manipulating rod 97 is inserted into the insertion hole 81*d* of the valve mechanism 80. Then the protective member 90 is slightly tilted with respect to the bottom portion 20*c* of the ink cartridge 2, and the support shaft 20*h* located at the ink loading port 27 is engaged with the engaging hole 98*a* through the cutaway portion 98*b* of the protrusion engaging portion 98, against the force of the biasing portions 99, 99. Once the support shaft 20*h* and the engaging hole 98*a* get engaged, swinging the protective member 90 about the support shaft 20*h* according to the force of the biasing portions 99, 99 shifts the cutaway portion 98*b* of the engaging hole 98*a* by a predetermined angle with respect to the support shaft 20*h*, so that the surrounding wall 92 on the side of the lug portion 93 contacts the lower face of the bottom portion 20*c*. Thus, the protective member 90 can be fixedly attached to the ink cartridge 2.

While the protective member 90 is attached to the ink cartridge 2, applying a force against the force of the biasing portions 99, 99 can cause the protective member 90 to swing about the support shaft 20*h*, and causing the protective member 90 to swing so as to move the cutaway portion 98*b* of the protrusion engaging portion 98 to a position that allows the support shaft 20*h* to come out of the engaging hole 98*a* permits disengaging the support shaft 20*h* from the engaging hole 98*a* of the protrusion engaging portion 98, and thereby removing the protective member 90 from the ink cartridge 2.

The ink cartridge 2 is vacuum-packed in the containing material 105 with the protective member 90 attached thereto. When the protective member 90 is made to swing about the support shaft 20*h* for removal after opening the vacuum package, the manipulating rod 97 of the protective member 90 is inserted deeper into the insertion hole 81*d*, so that the tip portion of the manipulating rod 97 lifts the air intake valve 82 placed in the valve chamber 81*b* of the valve mechanism 80, as shown in FIG. 11. This causes a surrounding wall portion of the valve chamber 81*b* of the supporting part 81 to expand by elastic deformation, thereby causing the air intake valve 82 to open the insertion hole 81*d*, and thus introducing air into the ink chamber 21.

When replacing the ink cartridge 2, air is introduced into the ink chamber 21 upon removal of the protective member 90. Accordingly, air can be introduced into the ink chamber 21 by the time that the ink cartridge is mounted on the cartridge loading unit 3 of the printer 1. This inhibits the ink already loaded in the printer head 7, the ink tank 5, the ink supply tube 4, the ink collecting tube 12 or the like of the printer 1 from flowing backward.

The structure of the remaining portions of the ink cartridge according to the second embodiment is similar to that of the ink cartridge according to the first embodiment. Therefore, the same constituents are given the same numerals, and detailed description thereof will be omitted.

While the biasing portions 99, 99 are constituted of a leaf spring made of a synthetic resin in this embodiment, the biasing portions 99, 99 may be a leaf spring of a metal material, or a coil spring. Although the protective member 90 is configured to swing about the support shaft 20*h* and the protrusion engaging portion 98, this is only an exemplary configuration. Further, while the manipulating rod 97 is integrally formed with the protective member 90, the manipulating rod 97 may be connected to the air intake valve 82, or may be provided as an additional part between the protective member 90 and the air intake valve 82.

According to this embodiment, a mechanism is provided which includes the manipulating rod that opens the air intake valve by a movement through the air intake port toward the air intake valve, so as to enable opening and closing the air intake valve simply by moving the manipulating rod when detaching a protective member. Such mechanism assures that air is introduced into an ink chamber when the protective member is detached for mounting the ink cartridge on a printer. Also, since the air intake valve is opened prior to mounting the ink cartridge on the printer, the ink in an ink path of the printer is inhibited from flowing backward when the ink cartridge is mounted.

According to this embodiment, the detachment of the protective member includes a first operation of moving the protective member with respect to the casing keeping the protective member attached to the ink cartridge, and a second operation of removing the protective member. Opening the air intake valve in the first operation leads to opening the air intake valve prior to mounting the ink cartridge on the printer, which assures that air is introduced into the ink chamber. Besides, the ink in an ink path of the printer is inhibited from flowing backward when the ink cartridge is mounted.

According to this embodiment, the protective member is moved parallel to a face on which the air intake port is provided, for detachment from the ink cartridge, so that a projection provided on the protective member opens the air intake valve by the movement of the protective member. Such configuration assures that air is introduced into an ink chamber when the protective member is detached for mounting the ink cartridge on a printer.

According to this embodiment, a mechanism capable of opening and closing the air intake valve with a simple structure can be obtained, with the manipulating rod connected to the air intake valve projecting outward through the air intake port, such that the projection causes the manipulating rod to move through the air intake port toward the air intake valve when detaching the protective member, so as to open the air intake valve by the movement of the manipulating rod. Such mechanism assures that air is introduced into an ink chamber when the protective member is detached for mounting the ink cartridge on a printer. Also, the ink in an ink path of the printer is inhibited from flowing backward when the ink cartridge is mounted.

According to this embodiment, one of the casing and the protective member is provided with a slide groove formed in a direction parallel to a face on which the air intake port is provided, and the other is provided with a nail portion to be engaged with the slide groove. Such configuration assures that the air intake valve is opened when detaching the protective member, because the engagement of the slide groove and the nail portion allows the protective member to slide to thereby open the air intake valve. Besides, the ink in an ink path of the printer is inhibited from flowing backward when the ink cartridge is mounted on the printer.

According to this embodiment, the ink cartridge includes a nail portion protruding from an inner surface of the surrounding wall of the protective member, and the protrusion of the casing includes a slide groove, so that the protective member is attached to the ink cartridge by a sliding motion of the nail portion along the slide groove. Such configuration assures that the protective member slides in a direction parallel to the face on which the air intake port is provided when removing the protective member, so that the sliding motion of the protective member causes the projection to open the air intake valve, thus to introduce air into the ink chamber. Besides, the ink in an ink path of the printer is inhibited from flowing backward when the ink cartridge is mounted on the printer.

According to this embodiment, the protective member is provided with an outer nail portion on an outer surface thereof, and a locking wall that limits the movement of the protective member is provided with a nail engaging portion that engages with the outer nail portion, so that a sliding motion of the protective member engages the outer nail portion with the nail engaging portion, thus to attach the protective member to the ink cartridge. Such configuration inhibits the protective member attached by the sliding motion from being accidentally removed from the ink cartridge.

According to this embodiment, the protective member is swingably attached to the casing, so that the protective member is detached by a swinging motion thereof, which assures that the air is introduced into the ink chamber by the swinging motion for detaching the protective member. Also, since the air intake valve is opened prior to mounting the ink cartridge on the printer, the ink in an ink path of the printer is inhibited from flowing backward when the ink cartridge is mounted.

According to this embodiment, a manipulating rod that opens the air intake valve is provided, such that a swinging motion of the protective member causes the manipulating rod to move, thus to open the air intake valve. Such configuration assures that air is introduced into an ink chamber when the protective member is detached for mounting the ink cartridge on a printer. Also, the ink in the ink path of the printer is inhibited from flowing backward when the ink cartridge is mounted on the printer.

According to this embodiment, a mechanism capable of opening and closing the air intake valve with a simple structure can be obtained, with the protective member provided with the manipulating rod that opens and closes the air intake valve, such that a swinging motion of the protective member for detachment of the protective member causes the manipulating rod to move through the air intake port toward the air intake valve, thus to open the air intake valve by the movement of the manipulating rod. Such configuration assures that air is introduced into an ink chamber when the protective member is detached for mounting the ink cartridge on a printer. Also, the ink in the ink path of the printer is inhibited from flowing backward when the ink cartridge is mounted on the printer.

According to this embodiment, the ink cartridge includes a support shaft disposed substantially parallel to the face of the casing on which the air intake port is provided, and a protrusion engaging portion projecting from the protective member and including an engaging hole to be engaged with the support shaft, so that the support shaft gets engaged with the engaging hole through a cutaway portion provided in the protrusion engaging portion at a terminal position of the swinging motion of the protective member, thus to attach and detach the protective member. Such configuration assures that the protective member is caused to swing without fail when detaching the protective member, thereby ensuring that the air intake valve is opened by the swinging motion of the protective member thus to introduce air into the ink chamber. Also, the ink in the ink path of the printer is inhibited from flowing backward when the ink cartridge is mounted on the printer.

According to this embodiment, the ink cartridge includes a biasing portion that biases the protective member so as to be separated from the air intake port, so as to keep the air intake valve from being opened except when removing the protective member for replacing the ink cartridge. Such configuration prevents the protective member from being accidentally removed from the main body of the ink cartridge.

According to this embodiment, only the air intake valve is opened when detaching the protective member, while keeping the ink supply valve closed. Such arrangement inhibits air from intruding through the ink supply port even though the ink chamber remains depressurized when detaching the protective member, thus enabling introducing air through the air intake port.

According to this embodiment, a containing material that encloses the casing with the protective member attached thereto under a depressurized state is provided, so as to allow maintaining the depressurized state inside the ink chamber for a long time. Such arrangement prevents emergence of a bubble in the ink, thereby assuring desired ejection performance of the ink free from the problem of the bubble in the ink path of the printer.

As this description may be embodied in several forms without departing from the spirit of essential characteristics thereof, this embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An ink cartridge, comprising:

a casing accommodating therein an ink chamber;

an air intake port formed on the casing for introducing air into the ink chamber;

an air intake valve that opens and closes the air intake port, wherein the air intake valve is positioned within the air intake port;

a protective member removably attached to the casing so as to cover the air intake port;

a biasing member configured to bias the air intake valve to close the air intake port until a motion detaching the protective member from the casing; and a manipulating rod positioned between the air intake valve and the protecting member and configured to open the air intake valve by moving through the air intake port toward the air intake valve in response to the motion of the protective member, wherein the air intake valve is configured to remain within the air intake port and to be biased by the biasing member after the protective member is detached from the casing.

2. The ink cartridge according to claim 1, wherein the protective member is configured to first move with respect to the casing while remaining connected to the casing, and then to be disconnected from the casing; and the air intake valve is opened by the manipulating rod while the protective member is still connected to the casing.

3. The ink cartridge according to claim 1, wherein the protective member includes an opposing face that opposes a face on which the air intake port is provided when attached to the casing, to be moved substantially parallel to the face on which the air intake port is provided, for detachment from the casing; and the protective member includes a projection formed on the opposing face so as to open the air intake valve by the motion of the opposing face.

4. The ink cartridge according to claim 3, wherein the manipulating rod is provided on the air intake valve so as to project through the air intake port; and the projection causes the manipulating rod to move in response to the motion of the protective member, so as to open the air intake valve.

5. The ink cartridge according to claim 3, wherein one of the casing and the protective member is provided with a slide groove formed in a direction substantially parallel to the face on which the air intake port is provided; and the other one of the casing and the protective member is provided with a nail portion to be engaged with the slide groove so as to be slidable.

6. The ink cartridge according to claim 5, further comprising a protrusion protruding from the face of the casing on which the air intake port is provided; wherein the slide groove is formed on the respective side faces of the protrusion in a direction substantially parallel to the face on which the air intake port is provided;

the protective member includes a surrounding wall around the opposing face; and the nail portion is located so as to project from each of opposing positions on an inner surface of the surrounding wall.

7. The ink cartridge according to claim 6, further comprising a locking wall formed so as to project in a direction intersecting with the sliding direction, on the face of the casing on which the air intake port is provided;

an outer nail portion formed so as to project in the sliding direction on an outer surface of the projector, and a nail engaging portion formed on the locking wall and including an opening that engages with the outer nail portion.

8. The ink cartridge according to claim 1, wherein the protective member is swingably attached to the casing so as to be closer to or spaced from a face on which the air intake port is provided, so as to detach the protective member from the casing by the swinging motion thereof.

9. The ink cartridge according to claim 8, wherein the manipulating rod is configured to move toward and open the air intake valve in response to the swinging motion of the protective member.

10. The ink cartridge according to claim 9, wherein the protective member includes an opposing face that opposes the face on which the air intake port is provided when attached to the casing; and the manipulating rod is formed so as to project from the opposing face, to be inserted through the air intake port toward the air intake valve by the swinging motion of the protective member, thus to open the air intake valve.

11. The ink cartridge according to claim 8, further comprising a support shaft disposed substantially parallel to the face of the casing on which the air intake port is provided; and a protrusion engaging portion formed so as to project from the protective member, and including an engaging hole to be engaged with the support shaft and a cutaway portion through which the support shaft is to be engaged or disengaged with the engaging hole at a terminal position of the swinging motion of the protective member, for supporting the protective member so as to swing about the support shaft engaged with the engaging hole.

12. The ink cartridge according to claim 11, further comprising a biasing portion that biases the protective member so as to be separated from the air intake port; wherein the protective member is detached by the swinging motion thereof against the force of the biasing portion, thus to open the air intake valve.

13. The ink cartridge according to claim 1, further comprising:

an ink supply port formed on the casing for supplying therethrough the ink in the ink chamber to outside; and an ink supply valve that opens and closes the ink supply port; wherein the protective member covers the ink supply port; and the manipulating rod opens the air intake valve in response to the motion of the protective member, while keeping the ink supply valve closed.

14. The ink cartridge according to claim 1, further comprising a containing material that encloses the casing with the protective member attached thereto, under a depressurized state.

15. The ink cartridge according to claim 1, wherein the air intake valve is temporarily opened by the motion detaching the protective member from the casing.

* * * * *